US007692616B2

(12) United States Patent
Nakamura et al.

(10) Patent No.: US 7,692,616 B2
(45) Date of Patent: Apr. 6, 2010

(54) LIQUID CRYSTAL DISPLAY APPARATUS AND MONITOR SYSTEM HAVING THE SAME

(75) Inventors: Yuko Nakamura, Kariya (JP); Isamu Suzuki, Kariya (JP)

(73) Assignee: DENSO CORPORATION, Kariya (JP)

( * ) Notice: Subject to any disclaimer, the term of this patent is extended or adjusted under 35 U.S.C. 154(b) by 714 days.

(21) Appl. No.: 11/520,594

(22) Filed: Sep. 14, 2006

(65) Prior Publication Data

US 2007/0070003 A1 Mar. 29, 2007

(30) Foreign Application Priority Data

Sep. 22, 2005 (JP) ..... 2005-275651

(51) Int. Cl.
*G09G 3/36* (2006.01)

(52) U.S. Cl. ..... 345/96; 345/101

(58) Field of Classification Search ..... 349/33–55; 345/38, 87–104

See application file for complete search history.

(56) References Cited

U.S. PATENT DOCUMENTS

| | | | | |
|---|---|---|---|---|
| 4,393,379 | A * | 7/1983 | Berting et al. | 345/100 |
| 5,489,917 | A * | 2/1996 | Ikezaki et al. | 345/89 |
| 5,818,408 | A * | 10/1998 | Mihara et al. | 345/94 |
| 6,476,792 | B2 * | 11/2002 | Hattori et al. | 345/102 |
| 6,927,755 | B2 * | 8/2005 | Chang | 345/101 |
| 6,930,667 | B1 * | 8/2005 | Iijima et al. | 345/101 |
| 2001/0000662 | A1 * | 5/2001 | Hashimoto et al. | 345/96 |
| 2002/0075216 | A1 * | 6/2002 | Satake | 345/89 |
| 2002/0140664 | A1 * | 10/2002 | Enomoto et al. | 345/103 |
| 2003/0090442 | A1 * | 5/2003 | Hattori et al. | 345/60 |
| 2004/0150606 | A1 * | 8/2004 | Preston | 345/100 |
| 2005/0046760 | A1 * | 3/2005 | Usami | 349/17 |
| 2005/0062712 | A1 * | 3/2005 | Noda | 345/101 |
| 2005/0253799 | A1 * | 11/2005 | Kamio | 345/103 |

FOREIGN PATENT DOCUMENTS

| | | | |
|---|---|---|---|
| JP | A-63-249825 | | 10/1988 |
| JP | 08179728 | A * | 7/1996 |
| JP | 2004104209 | A * | 4/2004 |
| JP | A-2004-104209 | | 4/2004 |
| JP | A-2004-177575 | | 6/2004 |
| JP | A-2004-219933 | | 8/2004 |
| JP | A-2004-226470 | | 8/2004 |

* cited by examiner

*Primary Examiner*—Alexander Eisen
*Assistant Examiner*—Patrick Marinelli
(74) *Attorney, Agent, or Firm*—Posz Law Group, PLC

(57) ABSTRACT

A liquid crystal display apparatus includes a liquid crystal panel having a matrix of pixels, a control circuit, and a temperature sensor. The temperature sensor directly or indirectly detects a temperature of the liquid crystal panel. The control circuit reverses a polarity of a voltage applied to each pixel at a time interval variable with the detected temperature, while keeping a field frequency constant. The time interval is a positive integer multiple of the reciprocal of a field frequency, i.e., a positive integer multiple of a field period. When the temperature of the liquid crystal layer is low, the control circuit reverses the polarity of the voltage at a longer time interval. In contrast, when the temperature of the liquid crystal layer is high, the control circuit reverses the polarity of the voltage at a shorter time interval.

9 Claims, 5 Drawing Sheets

TD
Sr
H
L
Vd
Vc
Vla
-15°C
1H
k
k+1
k+2
k+3
k+4
k+5
k+6
k+7
ta
tb
t

+SL1
-SL1
DL1
ON
OFF
(1, 1)
(1, 2)
(1, 3)
(2, 1)
(2, 2)
(2, 3)
(3, 1)
(3, 2)
(3, 3)

LIQUID CRYSTAL DISPLAY APPARATUS AND MONITOR SYSTEM HAVING THE SAME

CROSS REFERENCE TO RELATED APPLICATION

This application is based on and incorporates herein by reference Japanese Patent Application No. 2005-275651 filed on Sep. 22, 2005.

FIELD OF THE INVENTION

The present invention relates to an active matrix liquid crystal display apparatus and a monitor system having the same.

BACKGROUND OF THE INVENTION

Recently, a liquid crystal display (LCD) has been developed that has high resolution, wide viewing angle, and low power consumption. However, problems still need to be solved before the LCD replaces a cathode-ray tube (CRT). For example, in a twisted nematic (TN) LCD, moving images may appear blurred, i.e., leave a ghost or trail across the LCD at low temperature.

An electro optical panel disclosed in JP-2004-219933A includes a temperature compensation device having a temperature detection section to detect temperature of an image display area. Duration of application of a drive signal is increased in accordance with the detected temperature in order to prevent reduction in contrast ratio.

A LCD apparatus disclosed in JP-2004-177575A includes a frame frequency conversion section a temperature detection section. The frame frequency conversion section converts a frame frequency of an image signal supplied to a liquid crystal panel by interpolating sub flames into an input image frame in order to improve quality of moving images displayed on the liquid crystal panel. The temperature detection section detects temperature of the liquid crystal panel. A frame frequency conversion ratio decreases with a decrease in the detected temperature so that a liquid crystal responses within an image display period.

In a LCD apparatus disclosed in US 2005/0062712A1 corresponding to JP 2005-77946A, the number of times of repetitively outputting the same display data of one image to a liquid crystal panel is set in accordance with temperature of the liquid crystal panel in order to reduce a display frequency of the liquid crystal panel in a pseudo manner.

In a LCD apparatus disclosed in JP 2004-226470A, a display signal voltage is applied to pixels by a field reverse drive method when temperature of a liquid crystal is lower than a reference temperature and the display signal voltage is applied to the pixels by a line reverse drive method when the temperature of the liquid crystal is higher than the reference temperature.

Such a LCD apparatus is used as an in-vehicle monitor, for example, for a rear view monitor system in which a rear camera captures an image of an environment behind the vehicle and the in-vehicle monitor displays the image. When the LCD apparatus is used for the in-vehicle equipment, the blurring of the moving images becomes clearly evident due to severe temperature environment, as compared to for a household electrical appliance such as a personal computer or a television.

During the winter in cold climates, temperature in the vehicle drops down to, for example, minus 40 degree Celsius (° C.). The rear view monitor system is used, for example, when a driver backs the vehicle out of a garage, i.e., as soon as the driver enters the vehicle. Therefore, the LCD apparatus need to clearly display the moving images under the severe low temperature conditions for a few minutes until the temperature in the vehicle is raised by a heater.

In the LCD apparatus disclosed in JP-2004-219933A, JP-2004-177575A, and US 2005/0062712A1, although the field frequency changes in accordance with the temperature of the liquid crystal panel in the direct or pseudo manner, the LCD apparatus may not smoothly display the images.

In the LCD apparatus disclosed in JP-2004-226470A, the drive method switches between the field reverse drive method and the line reverse drive method in accordance with the temperature. However the polarity of the display signal voltage is always reversed per one field on each pixel. Therefore, although flickers may be reduced, the blurring may not be reduced at the low temperature.

SUMMARY OF THE INVENTION

In view of the above-described problem, it is an object of the present invention to provide a liquid crystal display apparatus having a reduced blurring and flicker over a wide temperature range, and a monitor system having the same.

A liquid crystal display apparatus includes a display panel, a control circuit, and a temperature sensor. The display panel includes a liquid crystal layer, a pair of substrates having scan lines, data lines, and active elements. The liquid crystal layer is interposed between the substrates and the active elements are connected to the scan and data lines to provide a matrix of pixels. The temperature sensor directly or indirectly detects a temperature of the liquid crystal layer. The control circuit reverses a polarity of the voltage applied to each pixel at a time interval variable with the detected temperature while keeping a field frequency constant. The time interval is a positive integer multiple of the reciprocal of a field frequency, i.e., a positive integer multiple of a field period. For example, if the field frequency is 60 hertz, the time interval is the positive integer multiple of about 16.7 milliseconds (ms), i.e., 1/60 seconds.

In the liquid crystal display apparatus, the time interval is gradually controlled by the field period. When the temperature of the liquid crystal layer is low and viscosity of the liquid crystal layer is high, the control circuit reverses the polarity of the voltage at a longer interval. Thus, while the liquid crystal display apparatus is alternately driven with the voltage of opposite polarity, the responsiveness of the liquid crystal layer can be improved without a reduction in the amount contained in a moving image. Consequently, the liquid crystal display apparatus can display the moving image with a reduced blurring at a low temperature. In contrast, when the temperature of the liquid crystal layer is high and the viscosity of the liquid crystal layer is low, the control circuit reverses the polarity of the voltage at a shorter interval. Thus, the liquid crystal display apparatus can display the moving image with the reduced flicker at a high temperature.

BRIEF DESCRIPTION OF THE DRAWINGS

The above and other objectives, features and advantages of the present invention will become more apparent from the following detailed description made with reference to the accompanying drawings. In the drawings.

DETAILED DESCRIPTION OF THE PREFERRED EMBODIMENT

Figure 4:
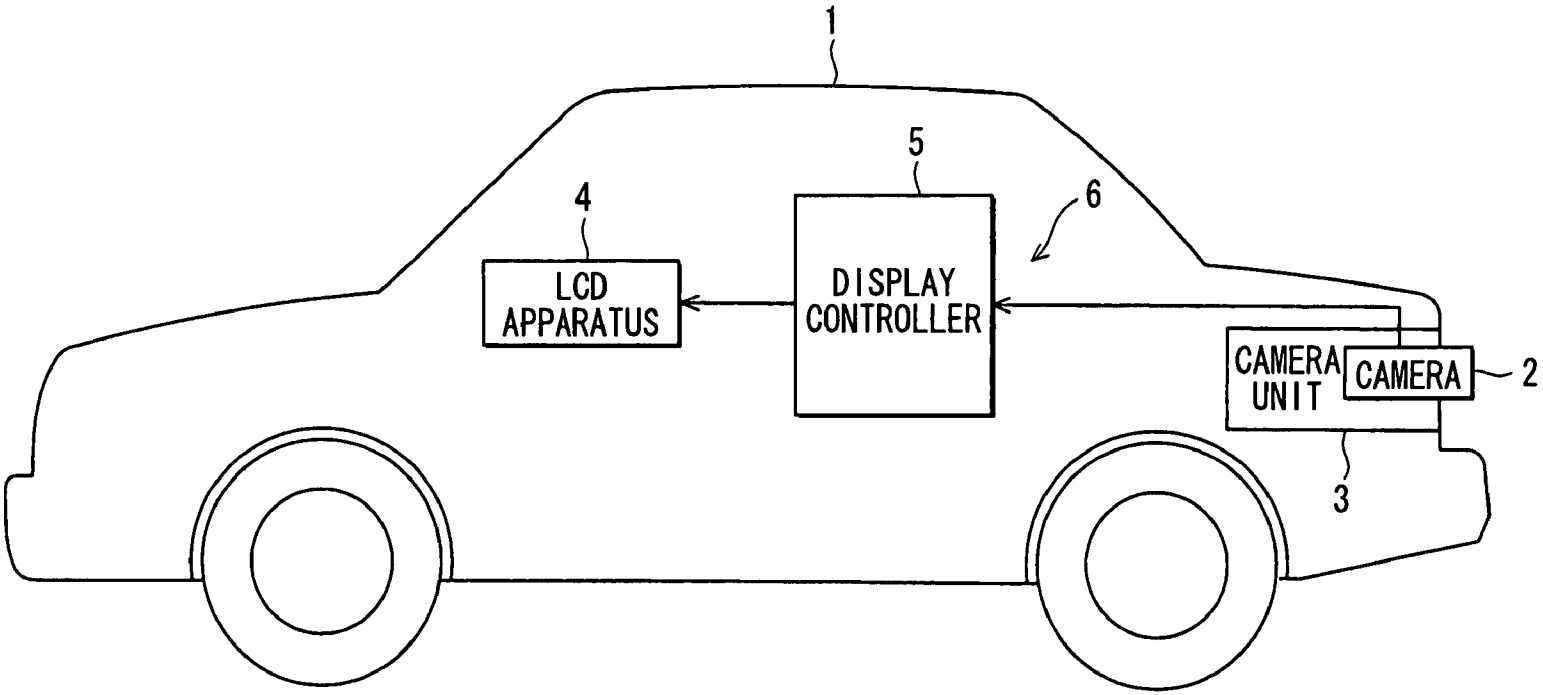
FIG. 4 is a view of a rear view monitor system having the liquid crystal display apparatus.

Referring to FIG. 4, a rear view monitor system 6 is installed in a vehicle 1. The monitor system 6 includes a camera unit 3 mounted on the rear of the vehicle 1, a liquid crystal display (LCD) apparatus 4 mounted on an instrument panel of the vehicle 1, and a display controller 5. The camera unit 3 has a charge-coupled device (CCD) camera 2 that provides images behind the vehicle 1 in color. The display controller 5 receives image signals from the camera 2, processes the received image signals, and outputs the processed image signals to the LCD apparatus 4. Thus, the LCD apparatus 4 displays the images behind the vehicle 1. When a car-navigation system is also installed in the vehicle 1, the car-navigation system and the monitor system 6 may share the LCD apparatus 4.

Figure 2A:
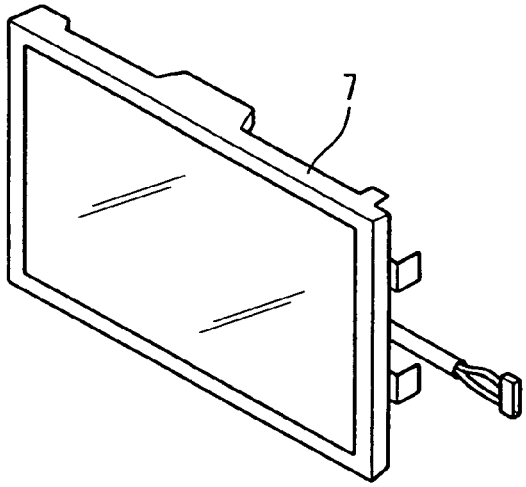
FIG. 2A is a view of a panel portion of the liquid crystal display apparatus.
Figure 2B:
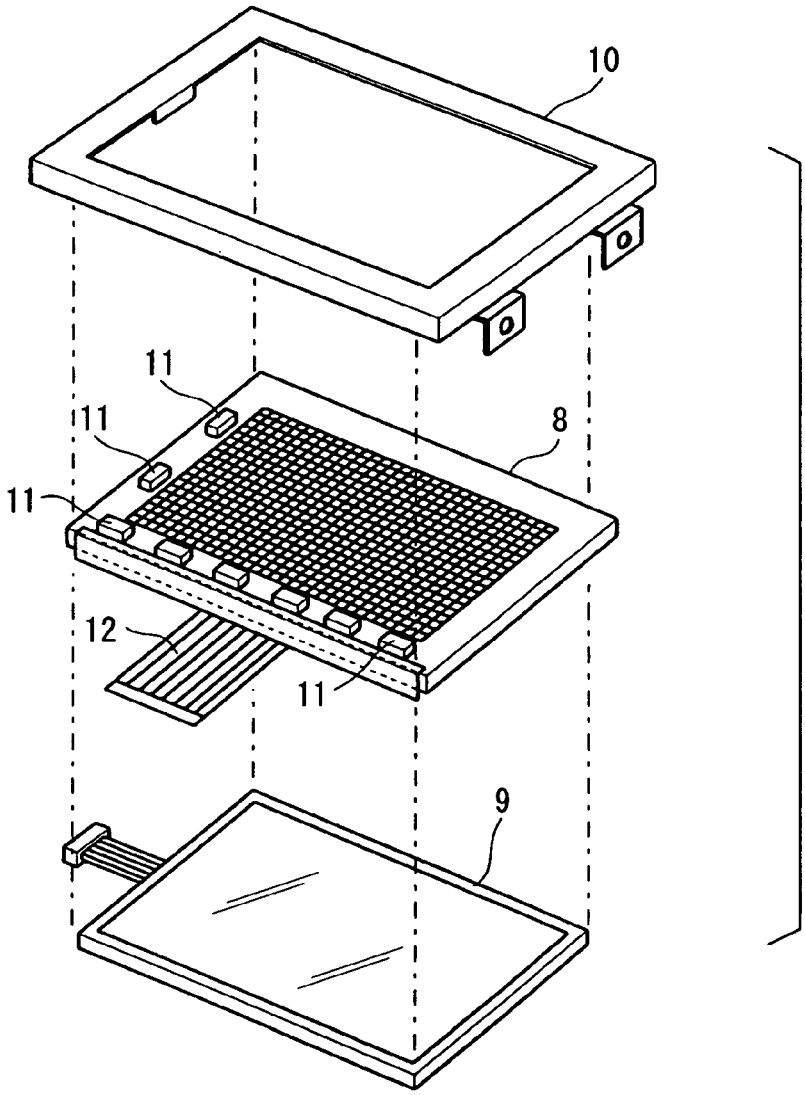
FIG. 2B is an exploded view of the panel portion of FIG. 2A.

Referring to FIGS. 2A and 2B, a panel portion 7 of the LCD apparatus 4 includes a LCD panel 8, a backlight panel 9, and a front case frame 10. The backlight panel 9 is placed on the back side of the LCD panel 8. The LCD panel 8 and the backlight panel 9 are housed in the front case frame 10. An integrated circuit (IC) 11 such as a driver IC and a flexible printed circuit (FPC) 12 are mounted to the LCD panel 8. The backlight panel 9 includes a lamp (e.g., hot-cathode tube, or cold-cathode tube), a light guide plate, an optical film such as a diffusing film, and the like.

Figure 3:
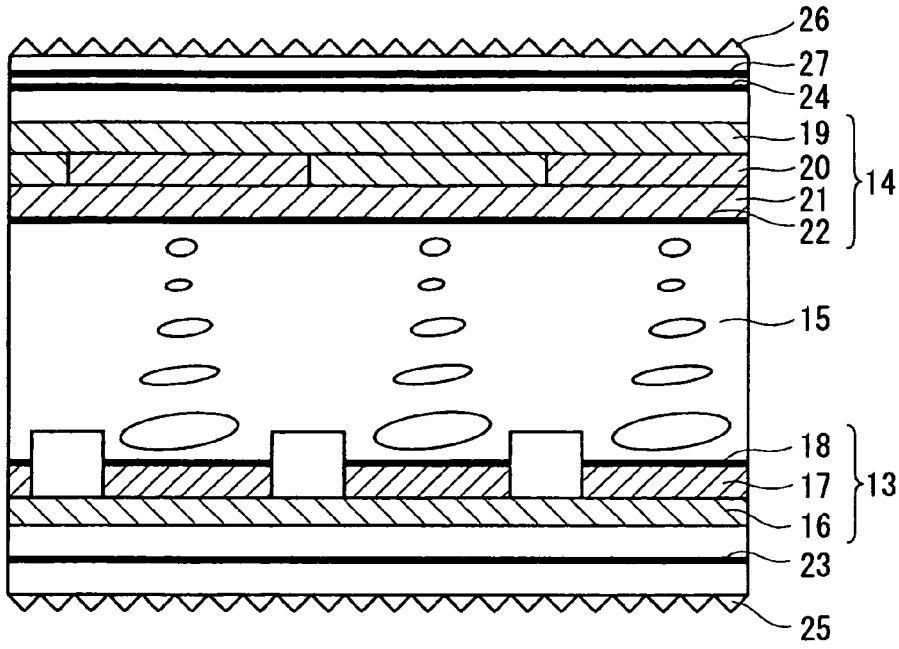
FIG. 3 is a cross-sectional view of a liquid crystal panel of the panel portion of FIG. 2B.

FIG. 3 is a schematic cross-sectional view of the LCD panel 8. The LCD panel 8 includes a thin-film transistor (TFT) substrate 13, a color-filter substrate 14, and a liquid crystal layer 15 interposed between the TFT substrate 13 and the color-filter substrate 14. The TFT substrate 13 has a glass substrate 16, a pixel electrode (i.e., transparent electrode) 17 formed on the grass substrate 16, and an oriented film 18 formed on the pixel electrode 17. The color-filter substrate 14 has a glass substrate 19, a common electrode 21, a color filter 20 interposed between the grass substrate 19 and the common electrode 21, and an oriented film 22 formed on the common electrode 21. Each of the pixel electrode 17 and the common electrode 21 is a transparent electrode and made from indium tin oxide (ITO), for example. Each of the oriented films 18, 22 may be, for example, a rubbed polyimide film.

The TFT substrate 13 and the color-filter substrate 14 are joined together such that rubbing directions of the oriented films 18, 22 are arranged perpendicular to each other. Then, nematic liquid crystals are injected between the TFT substrate 13 and the color-filter substrate 14 to form the liquid crystal layer 15. Polarizing films 23, 24 are attached to the outside of the TFT substrate 13 and the color-filter substrate 14, respectively. Antiglare films 25, 26 are attached to the outside of the polarizing films 23, 24, respectively. A wide viewing angle film 27 is interposed between the polarizing film 24 and the antiglare film 26.

Figure 1:
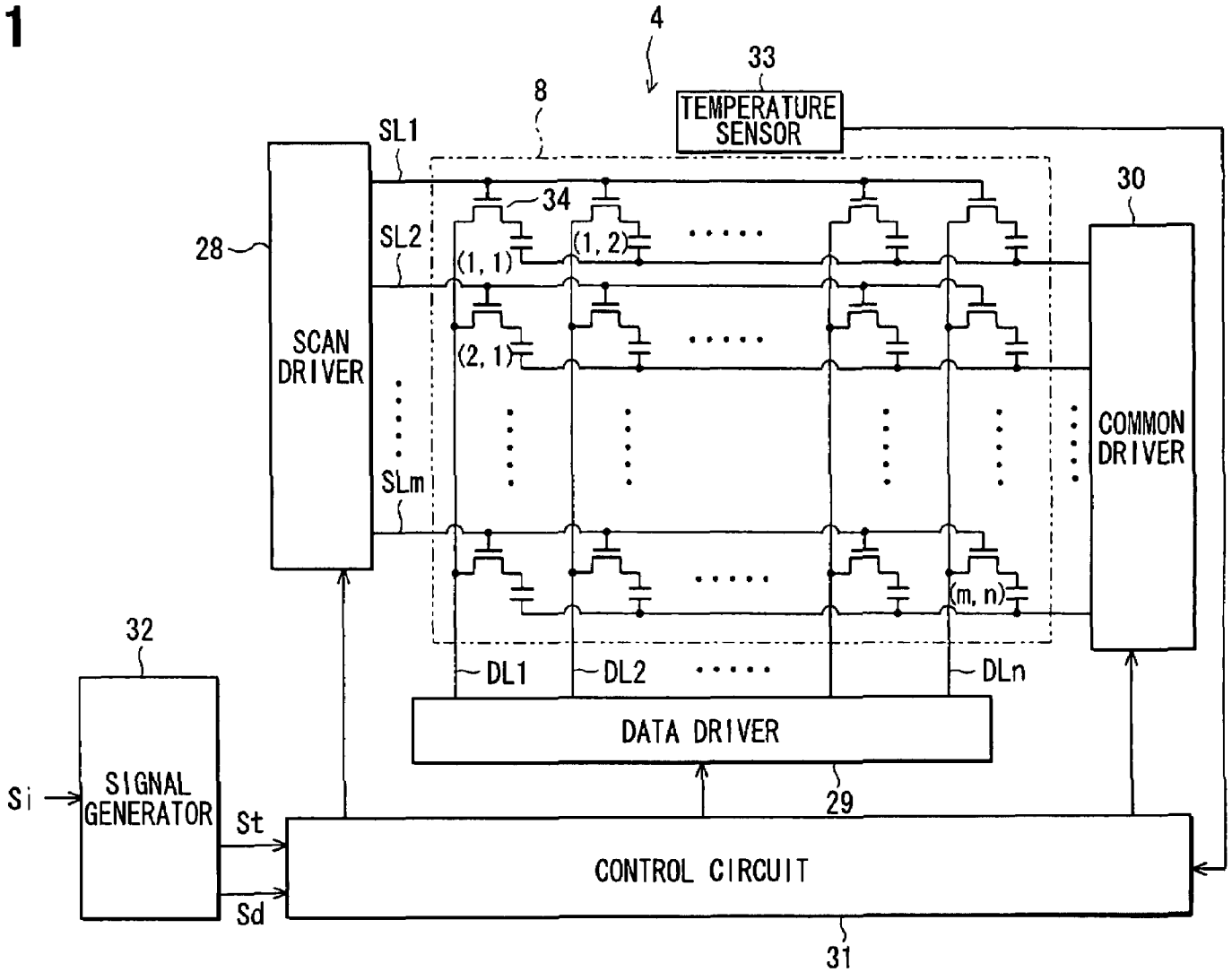
FIG. 1 is a block diagram of a liquid crystal display apparatus according to an embodiment of the present invention.

An electrical configuration of the LCD apparatus 4 is shown in FIG. 1. The LCD apparatus 4 includes the LCD panel 8, a scan driver 28, a data driver 29, a common electrode driver 30, a display control circuit 31, a display signal generation circuit 32, and a temperature sensor 33 having a thermistor, for example.

The LCD panel 8 has a matrix of pixels arranged in rows and columns. The scan driver 28 outputs a scan signal voltage to the pixels in each row. The data driver 29 outputs a data signal voltage to the pixels in a scanned row. The common electrode driver 30 outputs a common signal voltage to the common electrode 21. The display control circuit 31 outputs a control signal to each of the scan driver 28, the data driver 29, and the common electrode driver 30. The display signal generation circuit 32 extracts a timing signal St and a RGB data signal Sd from an image signal Si.

The IC 11 shown in FIG. 2B includes the scan driver 28 and the data driver 29. A graphic board (not shown) includes the common electrode driver 30, the display control circuit 31, and the display signal generation circuit 32. The IC 11 and the graphic board are connected together through the FPC 12 shown in FIG. 2B.

The TFT substrate 13 includes scan lines SL1-SLm arranged in rows and data lines DL1-DLn arranged in columns, where m and n are positive integers. An Intersection of the scan line SLi ($1 \leqq i \leqq m$) and the data line DLj ($1 \leqq j \leqq n$) define a pixel P(i, j). The pixel P(i, j) is provided with a TFT 34 having a source connected to the pixel electrode 17, a drain connected to the data line DLj, and a gate connected to the scan line SLi. A capacitor symbol shown in FIG. 1 represents an equivalent capacitance between the pixel electrode 17 and the common electrode 21 that faces the pixel electrode 17 through the liquid crystal layer 15.

The scan driver 28 successively applies the scan signal voltage to the scan line SLi synchronously with a vertical control signal input from the display control circuit 31 to select the pixels in each row. The data driver 29 receives the data signal Sd from the display signal generation circuit 32 row by row synchronously with a horizontal control signal input from the display control circuit 31. Then, the data driver 29 outputs the data signal voltage to the pixels in the scanned row through the data line DLj. The data driver 29 reverses the polarity of the data signal voltage.

The display signal generation circuit 32 extracts the timing signal St for each of a vertical synchronizing (VSYNC) signal and a horizontal synchronizing (HSYNC) signal from the image signal Si. Then, the display signal generation circuit 32 outputs the timing signal St and a clock signal to the display control circuit 31. Further, the display signal generation circuit 32 extracts the data signal Sd from the image signal Si and outputs the data signal Sd to the display control circuit 31.

The display control circuit 31 generates the vertical control signal, the horizontal control signal, and a common signal based on the VSYNC signal, the HSYNC signal, and the clock signal. The display control circuit 31 receives a temperature detection signal from the temperature sensor 33 and outputs the vertical control signal, the horizontal control signal, and the common signal to the scan driver 28, the data driver 29, and the common electrode driver 30, respectively, at a time interval controlled by the temperature detection signal. The common electrode driver 30 outputs the common signal voltage to the common electrode 21 in response to the data signal voltage applied to the pixel electrode 17.

The temperature sensor 33 is mounted in a position where the temperature sensor 33 can directly or indirectly detect a temperature of the liquid crystal layer 15 of the LCD panel 8. For example, the temperature sensor 33 may be mounted on an edge portion of a front face, an edge portion of a back surface, or a side face of the LCD panel 8. Thus, the temperature sensor 33 outputs the temperature detection signal indicating the temperature of the liquid crystal layer to the display control circuit 31. The display control circuit 31 calculates the temperature of the liquid crystal layer 15 from the temperature detection signal.

A response time of the liquid crystals to the application of a voltage increases with a decrease in temperature, because viscosity of the liquid crystals increases with the decrease in temperature. For example, the response time exceeds 100 ms at temperature below minus 20° C.

During the winter in cold climates, the temperature in the vehicle 1 may drop down to, for example, minus 40° C. The monitor system 6 is used, for example, when a driver backs the vehicle 1 out of a garage, i.e., as soon as the driver enters the vehicle 1. Therefore, the LCD apparatus 4 needs to clearly display the images under the severe low temperature conditions for a few minutes until the temperature in the vehicle 1 is raised by the heater.

In the LCD apparatus 4, while a field frequency is kept constant at, for example, 60 Hz (i.e., one field period is about 16.7 ms), the time interval, at which the polarity of voltage applied to the liquid crystals is reversed, changes with the temperature detected by the temperature sensor 33. In such an approach, the liquid crystals can respond under the low temperature conditions. Each pixel is driven by the line reverse drive method, regardless of the detected temperature.

Figures 5A, 5B, 5C, 5D, 5E:
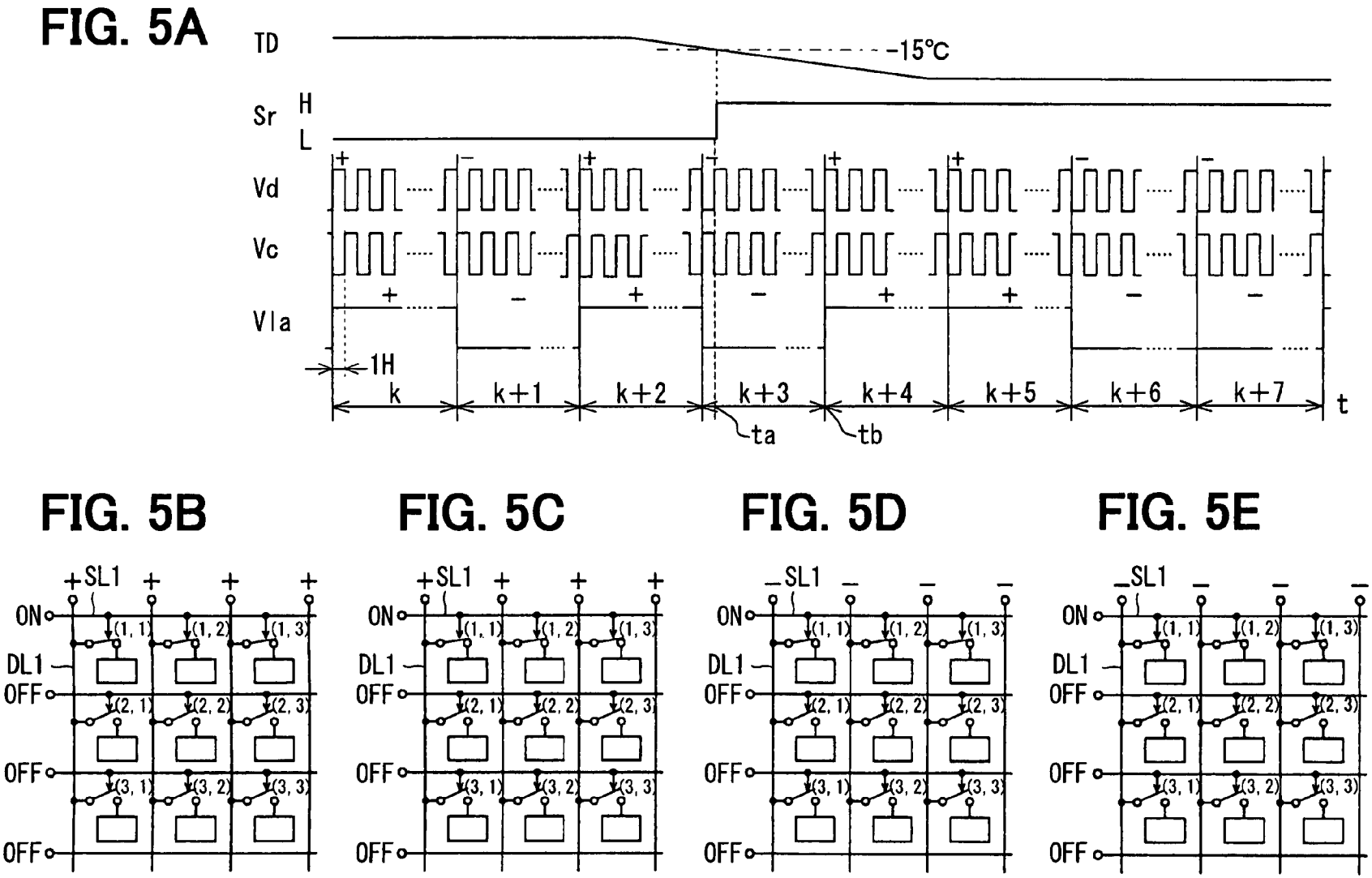
FIG. 5A is a graph of a liquid application voltage in each field period.
FIGS. 5B-5E are diagrams illustrating voltage application conditions in each pixel.

FIG. 5A is a graph illustrating a detected temperature TD of the liquid crystal layer 15, a polarity reversal period switching signal Sr, a data signal voltage Vd of the data line DL1, a common signal voltage Vc, a liquid application voltage V1*a* of the pixel (1,1) in a range from K field period to (K+7) field period, where K is an integer. As shown in FIG. 5A, the data signal voltage Vd and the common signal voltage Vc are reversed in polarity every horizontal scan period (1H) due to the line reverse drive method.

The liquid application voltage V1*a* is the difference between the data signal voltage Vd applied to the pixel electrode 17 and the common signal voltage Vc.

The switching signal Sr determines the time interval at which the liquid application voltage V1*a* is reversed in polarity. When the switching signal Sr is at low level, the liquid application voltage V1*a* is reversed in polarity every field period, i.e., at a first interval of about 16.7 ms. In contrast, when the switching signal Sr is at high level, the liquid application voltage V1*a* is reversed in polarity every two field periods, i.e., at a second interval of about 33.3 ms.

FIGS. 5B-5E are schematic diagrams illustrating voltage application conditions observed when the scan line SL1 is selected. FIG. 5B shows the voltage application condition of the pixel P (i, j) in (K+4) field period. Likewise, FIGS. 5C-5E show the voltage application conditions of the pixel P (i, j) in (K+5)–(K+7) field periods, respectively.

Figure 6:
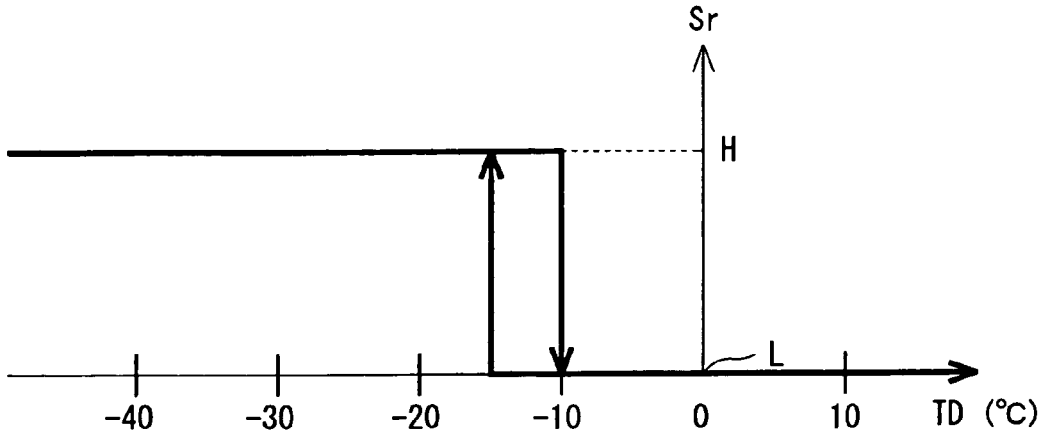
FIG. 6 is a graph showing a relationship between a detected temperature and a switching signal.

FIG. 6 is a graph showing a relationship between the detected temperature TD and the switching signal Sr. The display control circuit 31 changes the switching signal Sr from the low level to the high level when the detected temperature TD drops below a first threshold temperature of minus 15° C. In contrast, the display control circuit 31 changes the switching signal Sr from the high level to the low level when the detected temperature TD rises above a second threshold temperature of minus 10° C. Thus, a temperature hysteresis of 5° C. is obtained as shown in FIG. 6.

In FIG. 5A, the detected temperature TD drops to the first threshold temperature of minus 15° C. at a time Ta. During a period before the time Ta, therefore, the switching signal Sr is maintained at the low level by the display control circuit 31 and the liquid application voltage V1*a* is reversed in polarity every field period (i.e., at the first interval of about 33.4 ms). The liquid application voltage V1*a* of the pixel (1, 1) is positive in K, (K+2), (K+4), (K+6) field periods and is negative in (K+1), (K+3), (K+5), (K+7) field periods. Due to the line reverse drive method, the liquid application voltage V1*a* of the pixel (2, 1) is negative in K, (K+2), (K+4), (K+6) field periods and is positive in (K+1), (K+3), (K+5), (K+7) field periods.

The display control circuit 31 changes the switching signal Sr from the low level to the high level at the time Ta at which the detected temperature TD drops to the first threshold temperature of minus 15° C. Therefore, the liquid application voltage V1*a* is reversed in polarity every two field periods (i.e., at the second interval of about 33.4 ms) during a period after a time Tb at which the next period (i.e., K+4 field period) starts. The liquid application voltage V1*a* of the pixel (1, 1) is positive in (K+4), (K+5) field periods and is negative in (K+6), (K+7) field periods. Due to the line reverse drive method, the liquid application voltage V1*a* of the pixel (2, 1) is negative in (K+4), (K+5) field periods and is positive in (K+6), (K+7) field periods.

In the LCD apparatus 4, thus, the liquid application voltage V1*a* is reversed in polarity every field period during the period of time when the detected temperature TD is relatively high. When the detected temperature TD is relatively high, the viscosity of the liquid crystals is relatively low so that the liquid crystal can respond quickly. Therefore, even when the liquid application voltage V1*a* is reversed in polarity every field period, the blurring of the moving images can be reduced to an acceptable level. Further, reversing the polarity of the liquid application voltage V1*a* every field period increases time frequency of the alternating voltage applied to each pixel so that the flickers can be reduced.

In contrast, the liquid application voltage V1*a* is reversed in polarity every two field periods during the period of time when the detected temperature TD is relatively low. When the detected temperature TD is relatively low, the viscosity of the liquid crystal is relatively high so that the liquid crystal cannot respond quickly. Reversing the polarity of the liquid application voltage V1*a* every two field periods improves responsiveness of the liquid crystals. Thus, the blurring of the moving images can be reduced. Although the time frequency of the alternating voltage applied to each pixel is reduced to half, the flickers are unnoticeable due to the long response time of the liquid crystals.

Reversing the polarity of the liquid application voltage V1*a* every two field periods for a long time may result in deterioration of the liquid crystals. In this embodiment, the LCD apparatus 4 is a part of the monitor system 6 and installed in the vehicle 1. The liquid application voltage V1*a* is reversed in polarity every two field periods for only a few minutes until the temperature in the vehicle 1 is raised by the heater. Therefore, the deterioration of the liquid crystal can be negligible.

As described above, in the LCD apparatus 4, the temperature sensor 33 detects the detected temperature TD of the liquid crystal layer 15. During the winter in cold climates, the temperature in the vehicle drops to, for example, minus 40° C. When the detected temperature TD drops below the first threshold temperature of minus 15° C., the liquid application voltage V1*a* is reversed in polarity every two field periods. Thus, the LCD apparatus 4 reduces the blurring and flickers and clearly displays the moving images from the camera 2 under the severe low temperature conditions. Since the amount of information contained in the moving images is not reduced, the LCD apparatus 4 smoothly displays the moving images.

In contrast, during the summer, the temperature in the vehicle rises to, for example, plus 65° C. When the detected temperature TD rises above the second threshold temperature of minus 10° C., the liquid application voltage V1*a* is reversed in polarity every field period. Thus, the LCD apparatus 4 reduces not only the blurring but also the flickers and clearly displays the moving images from the camera 2 in the temperature range where the liquid crystals can respond quickly.

Thus, the LCD apparatus 4 can reduce the blurring and flickers in a balanced manner, over a wide temperature range (e.g., from minus 40° C. to plus 65° C.).

Due to the temperature hysteresis, frequent switching between the first and second intervals can be prevented so that a small change in the images displayed on the LCD apparatus 4 can be prevented.

The embodiments described above may be modified in various ways. For example, three or more threshold temperatures may be set and the interval at which the liquid application voltage V1*a* is reversed in polarity may change based on the three or more threshold temperature.

The temperature sensor 33 may indirectly detect the temperature of the liquid crystal layer 15. For example, the temperature sensor 33 may detect a temperature near the liquid crystal layer 15.

A field reverse drive method or a dot reverse drive method can be used instead of the line reverse drive method. Alternatively, both the line reverse drive method and the field reverse drive method may be used. In this case, the line reverse drive method may be used when the detected temperature is higher than the threshold temperature and the field reverse drive method may be used when the detected temperature is lower than the threshold temperature. Thus, conventional drive circuits designed for the line drive reverse method can be used so that manufacturing cost of the LCD apparatus 4 can be reduced.

The LCD apparatus 4 can be widely used for various applications such as a front side monitor system, a car navigation system, an in-vehicle television system, a mobile phone, a home television set, a personal computer, or the like.

Such changes and modifications are to be understood as being within the scope of the present invention as defined by the appended claims.

What is claimed is:

1. A liquid crystal display apparatus operating at a predetermined field frequency, the liquid crystal display apparatus comprising:

a display panel including a pair of substrates that have a plurality of scan lines, a plurality of data lines, and a plurality of active elements connected to the scan and data lines to provide a matrix of pixels, the display panel including a liquid crystal layer having a plurality of liquid crystals and interposed between the substrates;

a control circuit for controlling a voltage applied to each of the pixels; and a temperature sensor configured to detect a temperature of or near the liquid crystal layer, wherein the control circuit reverses a polarity of the voltage at a time interval of N field periods while keeping the field frequency constant, where N is a positive integer, wherein the control circuit changes the integer N in accordance with the detected temperature, and wherein one field period is the reciprocal of the field frequency.

2. The liquid crystal display apparatus according to claim 1, wherein the control circuit sets the integer N to a first integer value when the detected temperature is lower than a threshold temperature and at the second time interval when the detected temperature is equal to or higher than the threshold temperature, and the threshold temperature is set based on viscosity of the liquid crystals of the liquid crystal layer.

3. The liquid crystal display apparatus according to claim 2, wherein the threshold temperature includes a first threshold temperature and a second threshold temperature higher than the first threshold temperature, and the control circuit changes the integer N from the second integer value to the first integer value when the detected temperature drops below the first threshold temperature and from the first integer value to the second integer value when the detected temperature rises equal to or above the second threshold temperature.

4. The liquid crystal display apparatus according to claim 2, wherein the first integer value is two, and the second integer value is one.

5. A monitor system for providing an image of an environment around a vehicle to a driver of the vehicle, the monitor system comprising:

a camera for capturing the image, and a display apparatus for displaying the image, wherein the display apparatus is defined in claims 1.

6. A liquid crystal display apparatus, comprising:

a pair of substrates having a plurality of scan lines, a plurality of data lines, and a plurality of active elements connected to the scan and data lines to provide a matrix of pixels;

a liquid crystal layer having a plurality of liquid crystals and interposed between the pair of substrates;

a control circuit configured to control a voltage applied to each of the pixels;

and a temperature sensor configured to detect a temperature of or near the liquid crystal layer, wherein the liquid crystal display apparatus operates at a constant field frequency, wherein the control circuit reverses a polarity of the voltage at a time interval of N field periods, wherein the control circuit changes the integer N in accordance with the detected temperature, and wherein one field period is the reciprocal of the constant field frequency, wherein N is a positive integer.

7. The liquid crystal display apparatus according to claim 6, wherein the control circuit sets the integer N to a first integer value when the detected temperature is lower than a threshold temperature and at the second time interval when the detected temperature is equal to or higher than the threshold temperature, and wherein the threshold temperature is set based on viscosity of the liquid crystals of the liquid crystal layer.

8. The liquid crystal display apparatus according to claim 7, wherein the threshold temperature includes a first threshold temperature and a second threshold temperature higher than the first threshold temperature, and wherein the control circuit changes the integer N from the second integer value to the first integer value when the detected temperature drops below the first threshold temperature and from the first integer value to the second integer value when the detected temperature rises equal to or above the second threshold temperature.

9. The liquid crystal display apparatus according to claim 7, wherein the first integer value is two, and the second integer value is one.

* * * * *